US006528475B1

(12) United States Patent
Gross et al.

(10) Patent No.: US 6,528,475 B1
(45) Date of Patent: Mar. 4, 2003

(54) USE AND PREPARATION OF PRIMARY AMINES TO IMPROVE OILY SOIL DETERGENCY OF CLEANING COMPOSITIONS

(75) Inventors: Stephen F. Gross, Souderton, PA (US); Robert J. Valesky, Hatboro, PA (US); Timothy C. Morris, Morton, PA (US); Robert J. Coakley, Cranford, NJ (US); George Smith, Austin, TX (US)

(73) Assignee: Cognis Corporation, Gulph Mills, PA (US)

( * ) Notice: Subject to any disclaimer, the term of this patent is extended or adjusted under 35 U.S.C. 154(b) by 0 days.

(21) Appl. No.: 09/680,086

(22) Filed: Oct. 5, 2000

Related U.S. Application Data

(60) Provisional application No. 60/160,260, filed on Oct. 19, 1999.

(51) Int. Cl.[7] ..... C11D 11/00; C11D 17/00; C11D 7/32

(52) U.S. Cl. ..... 510/457; 510/350; 510/445; 510/452; 510/499

(58) Field of Search ..... 510/499, 445, 510/457, 452, 350

(56) References Cited

U.S. PATENT DOCUMENTS

| | | | | | |
|---|---|---|---|---|---|
| 4,077,891 | A | | 3/1978 | Beimesch et al. | |
| 4,338,205 | A | * | 7/1982 | Wisotsky | 252/32.5 |
| 4,536,316 | A | | 8/1985 | Ramachandran | |
| 4,689,167 | A | * | 8/1987 | Collins et al. | 252/95 |
| 4,808,342 | A | | 2/1989 | Lund et al. | |
| 4,882,074 | A | * | 11/1989 | Kenyon et al. | 252/8.8 |
| 6,046,153 | A | * | 4/2000 | Chapman et al. | 510/443 |
| 6,191,093 | B1 | * | 2/2001 | Watson et al. | 510/400 |
| 6,291,415 | B1 | * | 9/2001 | Watson et al. | 510/400 |

* cited by examiner

*Primary Examiner*—Gregory DelCotto
(74) *Attorney, Agent, or Firm*—John E. Drach; Steven J. Trzaska

(57) ABSTRACT

A process for making a solid primary alkyl amine salt, and its use in a powdered laundry detergent.

13 Claims, No Drawings

USE AND PREPARATION OF PRIMARY AMINES TO IMPROVE OILY SOIL DETERGENCY OF CLEANING COMPOSITIONS

CROSS-REFERENCE TO RELATED APPLICATIONS

This application claims the benefit of copending provisional application Ser. No. 60/160,260 filed on Oct. 19, 1999.

STATEMENT REGARDING FEDERALLY SPONSORED RESEARCH OR DEVELOPMENT

Not applicable.

BACKGROUND OF THE INVENTION

The present invention generally relates to cleaning compositions having enhanced oily soil detergency. Detergents are substances used to remove soil from materials with water. Since detergents are used under various conditions, e.g., type of soil, material to be cleaned, water temperature, etc., it is not surprising that many different types of detergents are available. One class of detergents are the bar soaps, liquid soaps, and liquid shampoos used for personal cleaning. A second class of detergents are the "light-duty" liquids and powders used for dishwashing and miscellaneous household cleaning. A third class of detergents are the "heavy duty" liquids and powders primarily used for cleaning clothes in washing machines.

All detergents contain at least one surfactant. A surfactant is a substance having molecules which contain both hydrophilic and oleophilic groups. The surfactants are primarily responsible for the soil-removing properties of the detergent, although many other components of the detergent augment the surfactants. Surfactants are routinely classified according to their electrostatic charge: the nonionics possess no net electrostatic charge, the anionics possess a negative charge, the cationics possess a positive charge, and the amphoterics possess both positive and negative charges.

Most detergents contain many other substances in addition to surfactants. Some detergents contain builders which aid the soil-removing properties of the surfactants in several ways. In particular, builders help prevent the formation of insoluble soap deposits, aid in soap suspension, and help prevent the precipitation of certain calcium and magnesium salts. Some detergents employ hydrotropes to reduce their viscosity and to prevent phase separation. Fillers are used in some detergents to control density and improve flow properties. Many heavy-duty detergents contain anti-redeposition agents to help prevent redeposition of soil on the clothes. Other ingredients commonly found in detergents are perfumes, corrosion inhibitors, pH adjusters or buffers, dyes or colorings, optical brighteners, foam control agents, bleaches, opacifiers, and stabilizers. Most types of detergents are sold both as powders and as liquids.

Although some powders are prepared by mixing together dry ingredients, the vast majority of powders are prepared by drying an aqueous slurry of ingredients. The popularity of the liquids continues to increase, primarily because of their convenience to the consumer, but also because of the savings associated with eliminating the drying step.

BRIEF SUMMARY OF THE INVENTION

The present invention is directed to a powdered detergent composition containing an effective amount of a solid primary alkyl amine salt corresponding to formula I:

$$R—N^+H_3—X^-—M \quad (I)$$

wherein R is a branched or linear alkyl group having from about 6 to about 18 carbon atoms, X is an acid group and M is a salt forming cation or hydrogen.

The present invention is also directed to a process for making a solid primary alkyl amine salt involving the steps of:

(a) forming a crutcher slurry by combining the following components, in the order shown:
  (i) from about 44 to about 64% by weight, of water;
  (ii) from about 5 to about 25% by weight, of a salt;
  (iii) from about 1 to about 11% by weight, of a strong acid; and
  (iv) from about 15 to about 35% by weight of a primary alkyl amine having from about 6 to about 18 carbon atoms; and (b) drying the crutcher slurry to form the solid primary alkyl amine salt.

The present invention is also directed to a process for enhancing the oily soil detergency of a powdered detergent composition by adding an effective amount of a primary alkyl amine salt to the powdered detergent.

BRIEF DESCRIPTION OF THE SEVERAL VIEWS OF THE DRAWING

Not applicable.

DETAILED DESCRIPTION OF THE INVENTION

Other than in the operating examples, or where otherwise indicated, all numbers expressing quantities of ingredients and reaction conditions are to be understood as being modified, in all instances, by the term "about".

It has been surprisingly discovered that the use of a primary alkyl amine in a cleaning composition such as, for example, a laundry detergent, enhances the oily soil detergency of the composition. At a neutral pH, the amine molecule is tied up as a zwitterionic salt which has little, if any, odor. However, a problem associated with the use of a primary alkyl amine is that at alkaline pH's, such as those associated with most cleaning compositions, the amine is freed causing a severe odor to be liberated.

One way to preclude the release of such odor is to first form a salt of the primary alkyl amine. However, in order to incorporate the primary alkyl amine salt into a powdered detergent, it must first be made into a solid. The solid primary alkyl amine salt can then be dry blended into a powdered detergent. Thus, in the absence of any water, the amine salt should not interact with any alkaline components present in the powdered detergent. However, when the powdered detergent is dissolved in a washing machine, the alkaline components will break up the salt, thus releasing the primary alkyl amine.

The components used to make the solid primary alkyl amine salt include: water, a salt, a strong acid and a primary alkyl amine. Suitable acids which may be employed include, for example, phosphoric, hydrochloric and sulfuric acids.

Primary alkyl amine starting materials which may be employed are those corresponding to formula I:

$$R—NH_2 \quad (I)$$

wherein R is an alkyl group having from about 6 to about 18 carbon atoms, and preferably from about 12–14 carbon atoms.

According to one aspect of the present invention, there is provided a process for making a solid primary alkyl amine salt involving the steps of: (a) forming a crutcher slurry containing: (i) from about 44 to about 64% by weight, preferably from about 49 to about 59% by weight, and most preferably from about 52 to about 56% by weight, of water; (ii) from about 5 to about 25% by weight, preferably from about 10 to about 20% by weight, of a salt, preferably sodium chloride; (iii) from about 1 to about 11% by weight, preferably from about 4 to about 8% by weight, of an acid, preferably sulfuric acid; and (iv) from about 15 to about 35% by weight, preferably from about 20 to about 30% by weight, of a primary alkyl amine, preferably a coco-amine; (b) mixing (i)–(iv), in the above-listed order, at room temperature, for a period of from about 5 to about 30 minutes or more; and (c) drying the crutcher slurry to form a solid product.

The solid product thus formed contains two-thirds primary alkyl amine salt and one-third salt.

The crutcher slurry is formed at room temperature, using conventional stirring/mixing techniques. Also, the crutcher slurry, thus formed, has a pH ranging from about 5 to about 8, and preferably about 6.5.

With respect to the drying step, it is performed using any known type of drying technique such as spray drying. The crutcher slurry is dried until less than 5% water remains therein.

According to another aspect of the present invention, there is provided a powdered detergent composition containing from about 0.1 to about 5% by weight, preferably from about 0.5 to about 4% by weight, and most preferably from about 1 to about 3% by weight, of the above-disclosed primary alkyl amine salt. This primary alkyl amine may be mixed with other conventional powder-form constituents typically employed in detergents. The powdered detergent composition thus formed has a pH of from about 8 to about 12, and preferably about 11, when dissolved at 10% in water.

Base powdered detergents will typically contain at least one surfactant selected from the group consisting of an anionic, nonionic, cationic, amphoteric, or zwitterionic surfactant, as well as mixtures thereof, and a builder component.

Useful builders include any of the conventional inorganic water-soluble builder salts such as, for example, salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates and the like.

Specific examples of inorganic phosphate builders include sodium and potassium tripolyphosphates, pyrophosphates, and hexametaphosphates. The organic polyphosphonates specifically include, for example, the sodium and potassium salts of ethane 1-hydroxy-1,1,-diphosphonic acid and the sodium and potassium salts of ethane-1,1,2-triphosphonic acid.

Specific examples of non-phosphorous inorganic builders include water-soluble inorganic carbonate, bicarbonate and silicate salts.

Water-soluble organic builders are also useful. For example, the alkali metal ammonium and substituted ammonium acetates, carboxylates, polycarboxylates and polyhydroxysulfonates are useful builders for the compositions and processes of the invention. Specific examples of acetate and polycarboxylate builders include sodium, potassium, lithium, ammonium and substituted ammonium salts of ethylene diaminetetracetic acid, nitrilotriacetic acid, benzene polycarboxylic acids, carboxymethoxysuccinic acid and citric acid.

Water-insoluble builders may also be used, particularly, the complex silicates and more particularly, the complex sodium alumino silicates such as zeolites. The zeolites may be amorphous or crystalline and have water of hydration as known in the art.

The use of an inert, water-soluble filler salt is desirable in the laundering compositions of the invention. A preferred filler salt is an alkali metal sulfate, such as, potassium or sodium sulfate.

Various adjuvants may be included in the laundry detergent compositions of the invention. In general, these include perfumes, colorants, bleaches such as sodium perborate, antiredeposition agents such as alkali metal salts of carboxymethyl-cellulose, optical brighteners such as anionic, cationic or nonionic brighteners, foam stabilizers such as alkanolamides, and the like, all of which are well-known in the fabric washing art for use in powdered detergents.

According to yet another aspect of the present invention, there is provided a process for enhancing the oily soil detergency properties of a base powdered detergent involving adding an effective amount of the above-disclosed solid primary alkyl amine salt to the powdered detergent. In a preferred embodiment from about 0.1 to about 5% by weight, preferably from about 0.2 to about 3% by weight, and most preferably from about 0.5 to about 1.5% by weight, of the above-disclosed primary alkyl amine salt is added to the base powdered detergent.

The present invention will be better understood from the examples which follow, all of which are intended for illustrative purposes only, and are not meant to unduly limit the scope of the invention in any way.

EXAMPLES

Preparation of Solid Primary Alkyl Amine Salt

The following components were mixed, in the precise order listed, at room temperature, for a period of 20 minutes, using a paddle mixer, to form a crutcher slurry.

| Component | %/wt. |
|---|---|
| (a) water | 40.0 |
| (b) NaCl | 15.0 |
| (c) $H_2SO_4$ (30%) | 20.0 |
| (d) primary coco-amine | 25.0 |
| | 100.0 |

The crutcher slurry was then dried until all of the water was eliminated using a forced air drying oven at 50° C. The finished product was a white, solid material consisting of approximately 66.7% coco-amine sulfate and approximately 33% NaCl.

Oily Soil Detergency

Fabric swatches containing various types of soils were washed in a terg-o-tometer to determine the oily soil detergency of various powdered detergent compositions. Their formulations as well as the detergency results are found in Table 1, below.

TABLE 1

| ΔR | Empa 101 | Empa 104 | Totals |
|---|---|---|---|
| Base laundry powder | 11.3 | 10.1 | 21.4 |
| Base powder + 1% active Deriphat 151-c[(1)] | 13.4 | 13.4 | 26.8 |
| Base powder + 1% active coco-amine sulfate | 15.9 | 14.3 | 30.2 |

[(1)]Deriphat 151-C = a $C_{12-14}$ alkyl amine consisting of approximately 20–30% primary amine, 60–70% secondary amine and 10–20% tertiary amine.
LSD 90% CI 0.5 1.2
Empa 101 = carbon black and olive oil on cotton
Empa 104 = carbon black and olive oil on poly/cotton
Terg-o-tometer conditions = 100° F., 100 rpm,
10 min. wash, cold rinse, 150 ppm water hardness, dose = 1.5 g/l As can be seen from the data above, a powdered detergent containing the primary alkyl amine salt of the present invention provides superior oily soil detergency.

What is claimed is:

1. A process for making a solid primary alkyl amine salt comprising:

(a) forming a crutcher slurry by combining:
  (i) from about 44 to about 64% by weight, of water;
  (ii) from about 5 to about 25% by weight, of a salt;
  (iii) from about 1 to about 11% by weight, of an acid; and
  (iv) from about 15 to about 35% by weight of a primary alkyl amine having from about 6 to about 18 carbon atoms, wherein (i)-(iv) are combined in the order shown; and (b) drying the crutcher slurry to form a solid primary alkyl amine salt.

2. The process of claim 1 wherein the water is present in the crutcher slurry in an amount of from about 52 to about 56% by weight, based on the weight of the slurry.

3. The process of claim 1 wherein the salt is present in the crutcher slurry in an amount of from about 10 to about 20% by weight, based on the weight of the slurry.

4. The process of claim 1 wherein the salt is sodium chloride.

5. The process of claim 1 wherein the acid is selected from the group consisting of sulfuric acid, phosphoric acid, hydrochloric acid, and mixtures thereof.

6. The process of claim 5 wherein the acid is sulfuric acid.

7. The process of claim 1 wherein the acid is present in the crutcher slurry in an amount of from about 4 to about 8% by weight, based on the weight of the slurry.

8. The process of claim 1 wherein the primary alkyl amine corresponds to formula I:

$$R—N^+H_3—X^-—M \quad (I)$$

wherein R is a branched or linear alkyl group having from about 6 to about 18 carbon atoms, X is an acid group and M is a salt forming cation or hydrogen.

9. The process of claim 8 wherein in formula I, R is an alkyl group having from 12 to 14 carbon atoms.

10. The process of claim 1 wherein the primary alkyl amine is present in the crutcher slurry in an amount of from about 20 to about 30% by weight, based on the weight of the slurry.

11. The process of claim 1 wherein the crutcher slurry is formed at room temperature.

12. The process of claim 1 wherein the crutcher slurry has a pH ranging from about 5 to about 8.

13. The process of claim 1 wherein the crutcher slurry has a pH of about 6.5.

* * * * *